US007302929B2

(12) United States Patent
Kondo

(10) Patent No.: US 7,302,929 B2
(45) Date of Patent: Dec. 4, 2007

(54) AIR BYPASS DEVICE IN MULTIPLE THROTTLE BODY

(75) Inventor: Yasushi Kondo, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/586,529

(22) Filed: Oct. 26, 2006

(65) Prior Publication Data

US 2007/0101971 A1 May 10, 2007

(30) Foreign Application Priority Data

Nov. 9, 2005 (JP) ..... 2005-324824

(51) Int. Cl.
*F02D 9/08* (2006.01)

(52) U.S. Cl. ..... 123/336; 123/337; 123/339.27

(58) Field of Classification Search ..... 123/336, 123/337, 339.27
See application file for complete search history.

(56) References Cited

U.S. PATENT DOCUMENTS 5,181,491 A * 1/1993 Izumi et al. ..... 123/336
5,522,362 A * 6/1996 Motose ..... 123/339.13
5,649,512 A * 7/1997 Flanery et al. ..... 123/339.23
5,979,388 A * 11/1999 Akagi et al. ..... 123/179.18
6,415,765 B1 7/2002 Akagi et al.
6,446,599 B1 * 9/2002 Nakayasu ..... 123/339.23
7,263,969 B2 * 9/2007 Sakamoto ..... 123/336
2007/0068487 A1 * 3/2007 Sakamoto ..... 123/336

FOREIGN PATENT DOCUMENTS

JP 2002-089415 3/2002

* cited by examiner

*Primary Examiner*—Erick Solis
(74) *Attorney, Agent, or Firm*—Bacon & Thomas, PLLC

(57) ABSTRACT

To improve an air bypass device in bypass air flow and designing freedom, a locking stepped part 3, a bush inserting hole 4, and a valve body drive mechanism inserting hole 5 are provided above an upper end 2*a* of a valve body guiding hole 2 of an air control valve main body 1, an air flow-in hole 6 is provided below a lower end 2*b* of the valve body guiding hole 2, and an inner peripheral wall 2*c* of the valve body guiding hole 2 includes a plurality of air control grooves 7*a* . . . extending downwardly from the locking stepped part 3 and being closed by an annular bush 11 on the locking stepped part 3 to form independent air distribution chambers 12*a* . . . , which are connected to intake passages 8*b*1 . . . at the downstream side from the respective throttle valves of multiple throttle bodies T1 . . . through bypass air passages 15*a* . . . .

5 Claims, 3 Drawing Sheets

AIR BYPASS DEVICE IN MULTIPLE THROTTLE BODY

BACKGROUND OF THE INVENTION

1. Field of the Invention

The present invention relates to an air bypass device, in which bypass air bypasses a throttle valve and is supplied to an intake passage at the down stream side from the throttle valve. More particularly, the present invention relates to an air by pass device in a multiple throttle body, in which a single air bypass device is used, and bypass air is supplied to intake passages at the down stream side from throttle valves of respective throttle bodies constituting the multiple throttle body.

2. Description of the Conventional Art

Japanese Patent Application Laid Open No. 2002-89415 discloses a conventional air bypass device.

The conventional air bypass device will be described using FIG. 6(*b*) in the relevant patent gazette (names and codes used in the gazette are used). An inlet 31 of a bypass passage is opened in a bottom part of a cylindrical valve body housing chamber 32. A circular first upstream side branch passage 36 and a circular second upstream side branch passage 37 are opened on an inner peripheral wall of the valve body housing chamber 32.

Openings of the first and second upstream side branch passages 36 and 37 opened on the inner peripheral wall of the valve body housing chamber 32 are controlled by a bypass valve 33 operated by a valve body drive mechanism 34.

Further, the first upstream side branch passage 36 is connected with a first downstream side branch passage 63, and the downstream of the first downstream side branch passage 63 is connected with an intake passage at the downstream side from a first throttle valve.

Further, the second upstream side branch passage 37 is connected with a second downstream side branch passage 65, and the downstream of the second downstream side branch passage 65 is connected with an intake passage at the downstream side from a second throttle valve.

Accordingly, openings of the first and second upstream side branch passages 36 and 37 opened in the valve body housing chamber 32 are controlled by a stroke of a bypass valve 33. Bypass air corresponding to the openings is supplied to the intake passages at the downstream side from the respective throttle valves through the first and second downstream side branch passages 63 and 65. Thus, an idling operation of an engine corresponding to atmosphere temperature of an engine can be carried out.

SUMMARY OF THE INVENTION

According to such the conventional air bypass device, respective upstream side branch passages are made by drilling toward the inside of the valve body housing chamber.

In a final stage of the drilling process, a drill bit penetrates into the valve body housing chamber having a cylindrical space. At the time of penetrating, a top end of the drill bit passes through the space without resistance, so that vibration occurs at the top end of the drill bit. Thereby, shapes of respective opening ends of the first and second upstream side branch passages opened in the valve body housing chamber may be varied and the concentricity of both the opening ends may be lost.

Accordingly, when openings of the first and second upstream side branch passages are controlled by a single bypass valve, a difference between the opening areas thereof is caused, so that equal bypass air may be hardly supplied to the respective intake passages.

Further, although it can be considered that the shape and the concentricity of the respective opening ends are inspected, much inspection time is needed since the openings are formed at the inside of the valve body housing chamber.

Further, passage diameters of the first and second upstream side branch passages are decided corresponding to air control characteristics to the stroke of the bypass valve. Thus, the first and second downstream side branch passages are connected toward the first and second upstream side branch passages formed to have comparatively small diameters.

Thereby, degree of freedom for passage designing of the downstream side branch passages is limited, and especially, development man-hours of the air bypass device of a multiple throttle body including a plurality of downstream side branch passages is increased.

Further, when the passage shapes of the upstream side branch passages are formed in a circular shape, openings of the upstream side branch passages controlled corresponding to movement of the bypass valve are controlled by only making the openings to be an incomplete circular shape. In such the structure, degree of freedom for selecting control characteristics of the amount of bypass air with respect to the moving stroke of the bypass valve is limited, so that it is not preferable. That is, the control characteristics of the amount of bypass air cannot be freely selected.

Furthermore, the valve body drive mechanism including the valve body housing chamber and the bypass valve is provided along the longitudinal axial line of the intake passage, and there is a tendency that the length in the longitudinal axial line direction of the intake passage passing through the throttle body becomes long. Thereby, increasing of intake efficiency of air flowing in the intake passage cannot be achieved.

The air bypass device in a multiple throttle body according to the present invention solves the above-described problems, and an objective of the present invention is to provide the air bypass device, in which bypass air correctly synchronized by a single air control valve can be supplied to a plurality of intake passages, and to provide the device having high degree of freedom for designing respective bypass air passages opened toward a plurality of intake passages.

In order to realize the above-described objectives, according to a first aspect of the present invention, an air bypass device in a multiple throttle body comprising intake passages, which are provided in a plurality of throttle bodies provided sideward and are controlled to be opened/closed by throttle valves, and bypass air passages, which bypass the throttle valves and are opened toward respective intake passages at the downstream side from the throttle valves, is structured such that a valve body guiding hole is provided in an air control valve main body so as to be approximately rectangular to a longitudinal axial line X-X of the intake passage; a bush inserting hole and a valve body drive mechanism inserting hole are provided continuously and upwardly from an upper end of the valve body guiding hole through a locking stepped part; an air flow-in hole is downwardly provided from a lower end of the valve body guiding hole; a plurality of independent air control grooves are opened and recessed at an inner peripheral wall of the valve body guiding hole downwardly from the locking stepped part of the upper end of the valve body guiding hole; the air control grooves are formed as a plurality of independent air distribution chambers by an annular bush which is provided in the bush inserting hole and contacted to the locking stepped part by a valve body drive mechanism provided in the valve body drive mechanism inserting hole; an air flow-in passage communicating with an intake passage at the upstream side from the throttle valve is opened and connected with the air flow-in hole, and the respective independent air distribution chambers are opened and connected with the respective intake passages at the downstream side from the throttle valves through bypass air passages; and the respective air control grooves opened at the inner peripheral wall of the valve body guiding hole are controlled to be opened/closed synchronously by an air control valve operated by the valve body drive mechanism.

Further, according to a second aspect of the present invention, in addition to the first aspect, the air flow-in passage, the valve body guiding hole, a plurality of the air control grooves, the bush inserting hole, and the valve body drive mechanism inserting hole at the air control valve main body are integrally formed by casting.

Further, according to a third aspect of the present invention, in addition to the first aspect, the air control grooves are formed such that groove width of external parts is larger than groove width of parts opened at the inner peripheral wall of the valve body guiding hole, and the upstream sides of the bypass air passages are connected with the external parts of the air control grooves.

Further, according to a fourth aspect of the present invention, in addition to the second aspect, groove width of the grooves opened at the inner peripheral wall of the valve body guiding hole are made smaller toward lower side from the upper locking stepped part.

Furthermore, according to a fifth aspect of the present invention, in addition to the first aspect, the air control main body is integrally formed between adjacent throttle bodies.

According to the first aspect, a valve body guiding hole is provided in the air control valve main body so as to be approximately rectangular to the longitudinal axial line of the intake passage. A plurality of the air control grooves for forming a plurality of the independent air distribution chambers is opened and formed at the inner peripheral wall of the valve body guiding hole downwardly from the locking stepped part of the upper end of the valve body guiding hole. The openings of a plurality of the air control grooves are controlled to be opened/closed by the single air control valve.

Therefore, air corresponding to the opening of the respective air control grooves controlled by the air control valve is supplied from the respective air distribution chambers to the intake passages at the downstream side from the throttle valves of the respective intake passages through the bypass air passages.

In this case, a plurality of the air control grooves are provided downwardly from the locking stepped part of the upper end of the valve body guiding hole. Further, air control grooves opened at the locking stepped part is closed by the annular bush so as to form a plurality of the independent air distribution chambers. The annular bush is provided on the locking stepped part and pressed by the valve body drive mechanism provided in the valve body drive mechanism inserting hole.

Accordingly, the upper ends of a plurality of the air control grooves are opened at the locking stepped part, and the openings are closed by the single annular bush, so as to form a plurality of the independent air distribution chambers at one time. So, the air bypass device including a plurality of bypass air passages can be produced with low cost.

Further, the air distribution chambers formed by the air control grooves are formed continuously and downwardly from the upper part along the valve body guiding hole. The upstream side of the bypass air passages communicating with the intake passages at the downstream side from the throttle valves may be opened and connected at a desired upper and lower directional position of the air distribution chambers which extends in the upper and lower direction. Thus, degree of freedom for designing the bypass air passages can be largely increased, and especially, it is preferable as an air bypass device in a multiple throttle body in which a plurality of bypass air passages are needed.

Further, the annular bush, which is provided on the locking stepped part and closes the openings of a plurality of the air control grooves opened at the locking stepped part so as to form a plurality of the air distribution chambers, is pressed by the valve body drive mechanism to be contacted and provided on the locking stepped part. The valve body drive mechanism is inserted and provided into the valve body drive mechanism inserting hole. Thereby, it is not necessary to press-in the annular bush into the bush inserting hole by large pressing force. Therefore, deforming of an inner diameter in the reduction direction of the hole, which is formed in the annular bush, can be prevented, and operation property of the air control valve can be preferably kept.

Further, the valve body guiding hole provided in the air control valve main body is formed so as to be approximately rectangular to the longitudinal axial line of the intake passage. Thereby, the air control valve provided in the valve body guiding hole and the valve body drive mechanism for operating the air control valve are also provided so as to be approximately rectangular to the longitudinal axial line of the intake passage. Therefore, overall length of the throttle bodies, that is, passage length of the intake passages can be shortened.

Accordingly, sucking efficiency of air flowing in the intake passages can be increased, and a chamber capacity of an air cleaner can be increased corresponding to a shortened distance of the passage length of the intake passage, and further, intake noise can be reduced.

Furthermore, the opening of the air control grooves provided in the vertical direction along the inner peripheral wall of the valve body guiding hole are controlled to be opened/closed by the air control valve moved in the vertical direction. Thus, by selecting the groove shape, the groove length, the groove width and the like, the control characteristics of the bypass air to the moving stroke of the air control valve can be suitably set corresponding to the requirement of an engine.

Further, according to the second aspect of the present invention, all of the air flow-in passage, the valve body guiding hole, a plurality of the air control grooves, the bush inserting hole including the locking stepped part, and the valve body drive mechanism inserting hole can be simultaneously formed by casting at the time of an injection molding of the air control valve main body. Thereby, the air control valve main body can be produced with low cost.

Especially, a positional relationship between the valve body guiding hole and a plurality of the air control grooves, and a positional relationship between the locking stepped part and the air control grooves can be correctly formed, and the openings of the respective air control grooves can be correctly and uniformly controlled by the air control valve.

Further, according to the third aspect of the present invention, the groove width of the external parts of the control air grooves is larger than the groove width of the air control grooves opened on the inner peripheral wall of the valve body guiding hole, and the upstream sides of the bypass air passages are connected with the external parts having the large groove width of the air control groove. Thus, especially, the degree of freedom for designing the bypass air passage can be largely increased, and it is preferable in the air bypass device using the single air control valve.

Further, according to the fourth aspect of the present invention, when a plurality of the air control grooves including the valve body guiding hole are formed by casting, the groove width of the air control grooves opened at the inner peripheral wall of the valve body guiding hole is made smaller toward lower side from the locking stepped part in the upper side of the valve body guiding hole. Thus, opening property between the moving stroke of the air control valve and the air control grooves, that is, control property of bypass air with respect to the moving stroke of the air control valve is made such that large amount of bypass air can be supplied in a final stage of moving of the air control valve.

Furthermore, according to the fifth aspect, the air control valve main body can be integrally formed between adjacent throttle bodies constituting the multiple throttle body. Thus, it is not necessary to individually prepare the air control valve main body, so that the number of parts can be reduced, and an attachment operation of the air control valve main body to the throttle body is not necessary.

DETAILED DESCRIPTION OF PREFERRED EMBODIMENT

Figure 1:
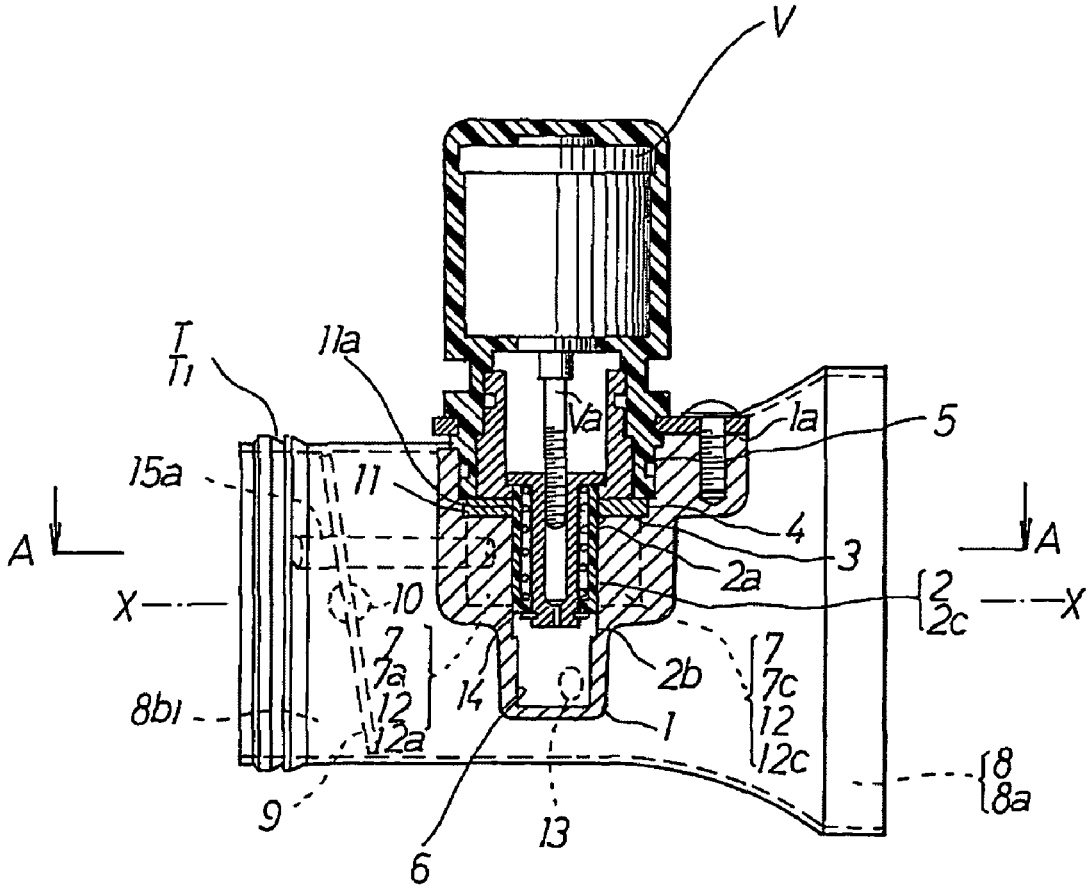
FIG. 1 is a longitudinal sectional view of main parts illustrating one example of an air bypass device in a multiple throttle body according to the present invention.
Figure 2:
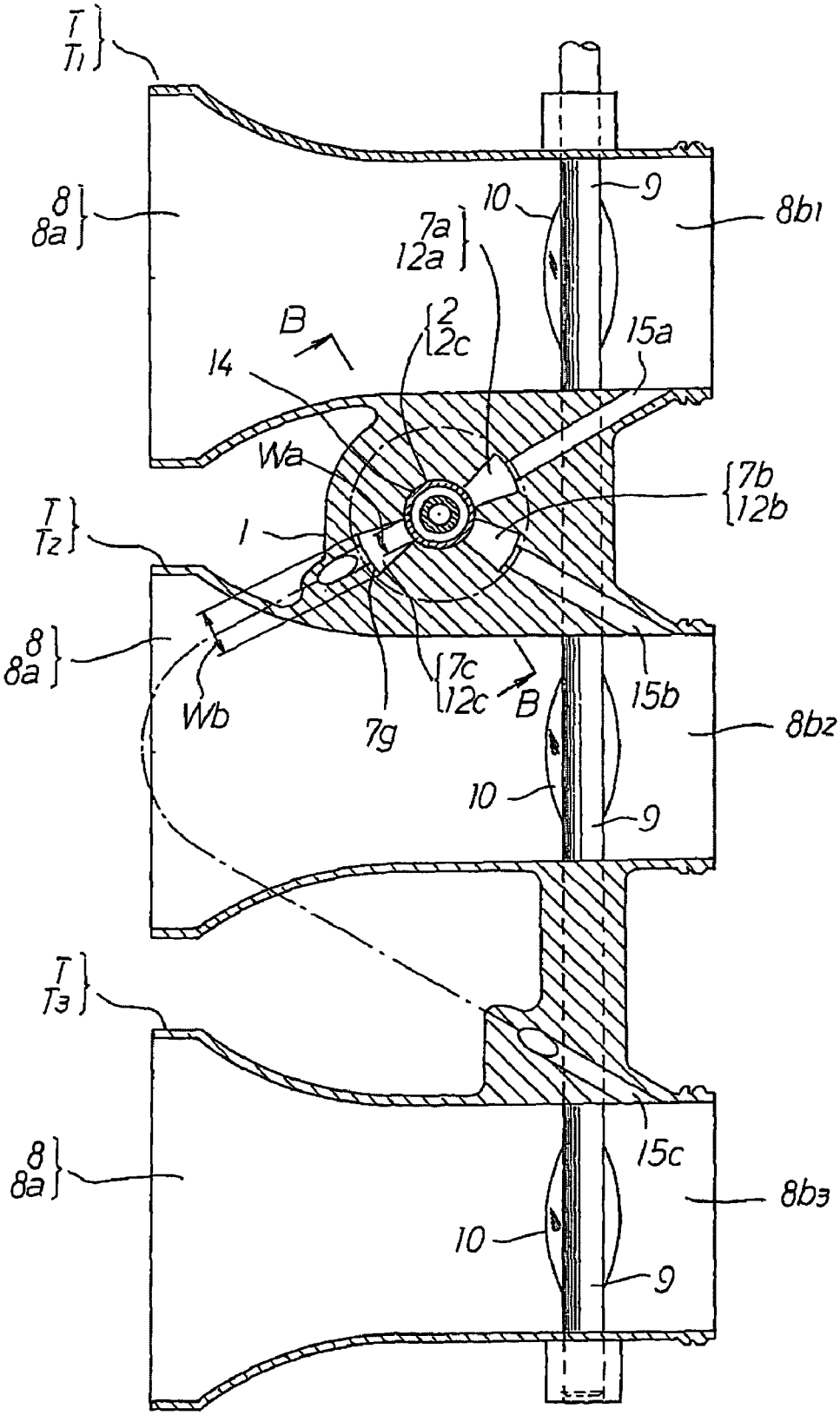
FIG. 2 is a cross sectional view taken along the line A-A in FIG. 1.
Figure 3:
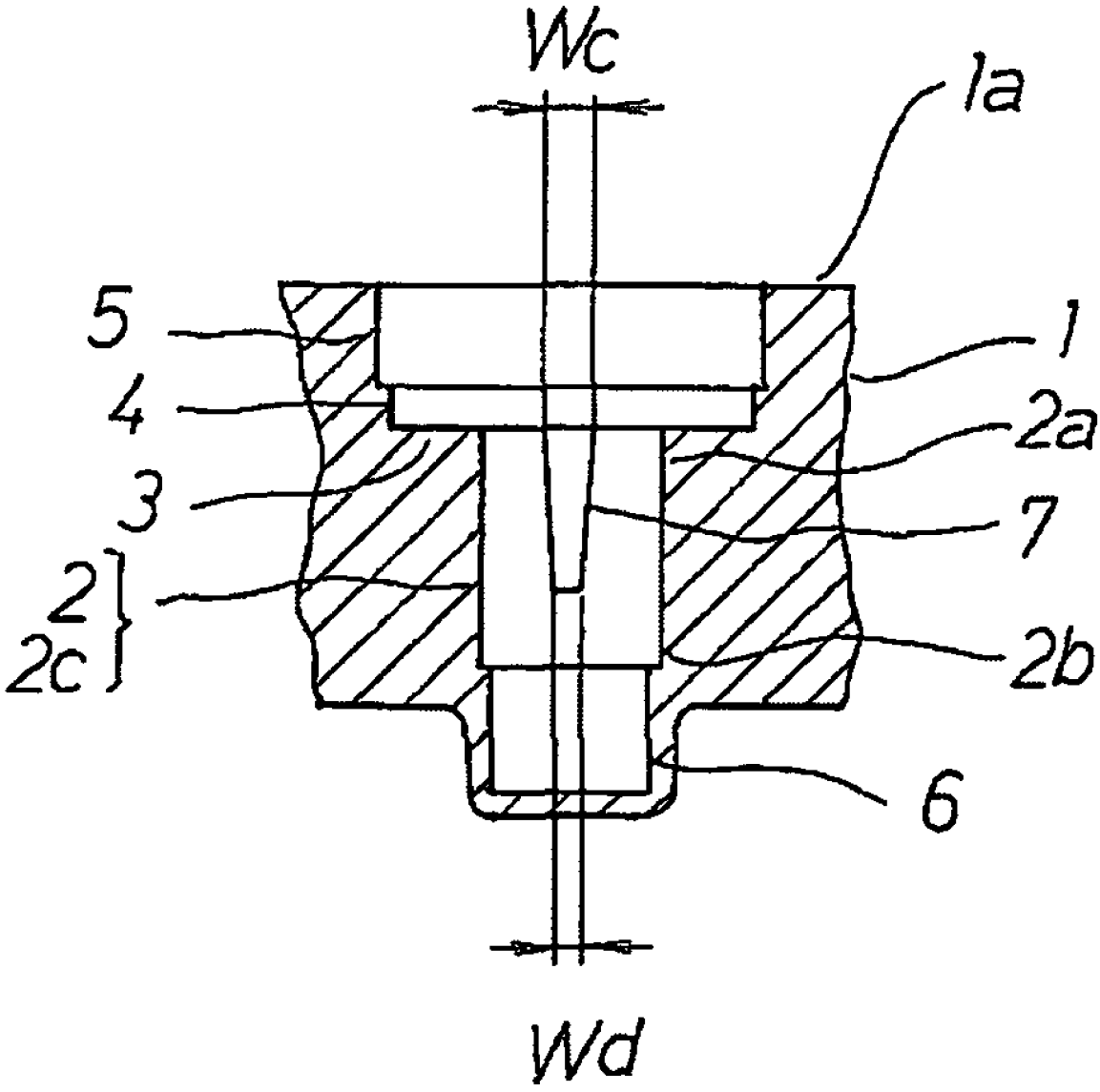
FIG. 3 is a longitudinal sectional view taken along the line B-B in FIG. 2 in the state before assembling an air control valve main body.

Hereinafter, one example of an air bypass device in a multiple throttle body according to the present invention will be described with drawings. FIG. 1 is a longitudinal sectional view of the device. FIG. 2 is a cross sectional view taken along the line A-A in FIG. 1. FIG. 3 is a longitudinal sectional view of main parts of an air control valve main body taken along the line B-B in FIG. 2

An air control valve main body 1 includes a valve body guiding hole 2 therein, and the valve body guiding hole is provided in the vertical direction so as to be approximately rectangular to the longitudinal axial line X-X of an intake passage described below.

An upper end 2*a* of the valve body guiding hole 2 is opened at an upper end la of the air control valve main body 1 through a locking stepped part 3, a bush inserting hole 4, and a valve body drive mechanism inserting hole 5. An air flow-in hole 6 is provided downwardly from a lower end 2*b* of the valve body guiding hole 2.

Further, at an inner peripheral wall 2*c* of the valve body guiding hole 2, a plurality of independent air control grooves 7 are provided so as to be opened downwardly from the locking stepped part 3 of the upper end 2*a* of the valve body guiding hole 2 in the vertical direction.

In this embodiment, three connecting throttle bodies are used, and a first air control groove 7*a*, a second air control groove 7*b* and a third air control groove 7*c* are formed. These grooves are clearly illustrated in FIG. 2.

In this case, throttle bodies T are provided with intake passages 8 passing through the inside thereof. The intake passages 8 are controlled to be opened/closed by throttle valves 10 attached to throttle valve shafts 9 rotatably supported by the throttle bodies T.

In this embodiment, the throttle bodies T are formed by three throttle bodies of a first throttle body T1, a second throttle body T2 and a third throttle body T3 integrally provided in the side direction thereof. The air control valve main body is integrally formed with the throttle bodies T between the first throttle body T1 and the second throttle body T2, which are adjacent each other.

Further, a flat single annular bush 11, which has a hole 11*a* provided with the same diameter as that of the valve body guiding hole 2, is inserted in the bush inserting hole 4. A lower end face of the annular bush 11 is contacted and provided on the locking stepped part 4. Further, an upper end face of the annular bush 11 is pressed and fixed by a lower end face of a valve body mechanism V, which is fixed and provided in the valve body drive mechanism inserting hole 5.

Thereby, upper end openings of the control air grooves 7*a*, 7*b* and 7*c*, which are opened on the locking stepped part 3, are closed by the annular bush 11, so that a plurality of independent air distribution chambers 12, that is, a first air distribution chamber 12*a*, a second air distribution chamber 12*b*, and a third air distribution chamber 12*c* are independently formed. Further, inner sides of the air distribution chambers 12*a*, 12*b* and 12*c* are independently opened at the inner peripheral wall 2*c* of the valve body guiding hole 2 by the air control grooves 7*a*, 7*b* and 7*c*.

Further, the air flow-in hole 6 is connected with an intake passage 8*a* at the upstream side from the throttle valve 10 or atmosphere through an air flow-in passage 13.

Further, as described above, the valve body drive mechanism V including a step motor, a wax element or the like is fixed and provided in the valve body drive mechanism inserting hole 5. An air control valve 14 is movably provided in the valve body guiding hole 2. This air control valve 14 comprises a plunger valve connected to an output rod Va extended from the valve body drive mechanism V.

Further, the first air distribution chamber 12*a* and an intake passage 8*b*1 at the downstream side from the throttle valve 10 of the first throttle body T1 are connected with a bypass air passage 15*a*. The second air distribution chamber 12*b* and an intake passage 8*b*2 at the downstream side from the throttle valve 10 of the second throttle body T2 are connected with a second bypass air passage 15*b*. The third air distribution chamber 12*c* and an intake passage 8*b*3 at the downstream side from the throttle valve 10 of the third throttle body T3 are connected with a third bypass air passage 15*c*.

According to the air bypass device in a multiple throttle body of the present invention having the above-described structure, the air control valve 14 is moved in the valve body guiding hole 2 by the output rod Va of the valve body drive mechanism V, which is operated corresponding to the atmosphere temperature of an engine, so as to control the openings of the air control grooves 7*a*, 7*b* and 7*c* corresponding to the atmosphere temperature of an engine.

Accordingly, air induced into the air flow-in hole 6 through the air flow-in passage 13 is controlled by the openings of the air control grooves 7*a*, 7*b* and 7*c*, which are opened at the inner peripheral wall 2*c* of the valve body guiding hole 2. The controlled bypass air is supplied to the intake passages 8*b*1, 8*b*2 and 8*b*3 at the downstream side from the throttle valves of the throttle body T1, T2 and T3 through the air distribution chambers 12*a*, 12*b* and 12*c* and the bypass air passages 15*a*, 15*b* and 15*c*. Thereby, a proper idling operation corresponding to the atmosphere temperature of an engine can be carried out.

According to the present invention, a plurality of the air control grooves 7*a*, 7*b* and 7*c* are provided downwardly from the locking stepped part 3 of the upper end 2*a* of the valve body guiding hole 2 in the vertical direction. Further, the openings of the air control grooves 7*a*, 7*b* and 7*c* opened on the locking stepped part 3 are closed by the annular bush 11 provided on the locking stepped part 3, so as to dividedly form a plurality of the air distribution chambers 12*a*, 12*b* and 12*c*.

Accordingly, a plurality of the air distribution chambers 12*a*, 12*b* and 12*c* can be formed at one time by closing the openings of a plurality of the air control grooves 7*a*, 7*b* and 7*c* opened at the locking stepped part 3 by the single annular bush 11. Thus, the number of parts and the number of press-in processing man-hours can be reduced, so that the air bypass device can be provided with low cost.

Further, the valve body drive mechanism V, which is provided in the valve drive mechanism inserting hole 5 and fixed to the air control valve main body 1, is contacted to the upper end face of the annular bush 11 provided in the bush inserting hole 4 and provided on the locking stepped part 3. So, the annular bush 11 can be lightly pressed into the bush inserting hole 4, so that the diameter of the hole 11*a* provided in the annular bush 11 is not decreased.

By this structure, excellent dynamic characteristics of the air control valve 14 inserted into the hole 11*a* can be obtained without being given operation resistance.

The operation resistance of the air control valve 14 can be decreased by increasing the diameter of the hole 11*a*. However, in such the structure, air flows in from the air control grooves opened at the locking stepped part 3, so as to prevent exact controlling of the bypass air.

Further, the air control grooves 7*a*, 7*b* and 7*c* are provided at the inner peripheral wall 2*c* of the valve body guiding hole 2 in the vertical direction. Thus, the groove shape, the groove length and the groove width of the air control grooves 7*a*, 7*b* and 7*c* can be freely selected. Thereby, the control characteristics of the bypass air to the moving stroke of the air control valve 14 can be suitably set corresponding to the request of an engine.

Further, the air distribution chambers 12*a*, 12*b* and 12*c* are formed extending in the vertical direction. Thus, the upstream sides of the bypass air passages 15*a*, 15*b* and 15*c* can be connected toward desired positions of the air distribution chambers 12*a*, 12*b* and 12*c* extended in the vertical direction, so that the bypass passages can be designed very easily. Even if an opening position of each bypass air passage to the air distribution chamber is varied, the difference in an amount of bypass air to be supplied does not occur.

Further, according to the present invention, the longitudinal axial lines of the air flow-in hole 6, the valve body guiding hole 2, the air control valves 14, and the valve body drive mechanism V are provided approximately rectangular to the longitudinal axial line X-X of the intake passage 8. Thus, the length of the intake passage 8 can be shortened, so that the sucking efficiency of air flowing in the intake passage 8 can be increased.

Further, the chamber capacity of the air cleaner can be increased corresponding to shortening of the length of the intake passage, so that the effect for reducing the intake noise can be realized.

Further, according to this embodiment, the air control valve main body 1 is integrally formed with the throttle bodies T at the time of injection molding of the throttle bodies T. Thus, it is not necessary to prepare the single air control valve main body 1 and attach the single air control valve main body 1 to the throttle bodies. So, production cost can be remarkably reduced. Further, the single air control valve main body 1 is provided between the adjacent throttle bodies T1 and T2, so that the device can be made compact.

Further, all of the holes provided at the air control valve main body 1, that is, the air flow-in hole 6, the valve body guiding hole 2, a plurality of the air control grooves 7*a*, 7*b* and 7*c*, the bush inserting hole 4 including the locking stepped part 3, and the valve body drive mechanism inserting hole 5, can be synchronously formed by casting at the time of injection molding of the throttle bodies. Thereby, the air control valve main body 1 can be provided with low cost. Further, relative positions of the openings of the air control grooves 7*a*, 7*b* and 7*c* opened at the inner peripheral wall 2*c* of the valve body guiding hole 2 and relative positions of the openings of the air control grooves 7*a*, 7*b* and 7*c* opened at the locking stepped part 3 can be exactly formed. Thus, the bypass air can be supplied stably and exactly.

Further, as for groove widths of the air control groove 7, a grove width Wb of external side parts 7*g* is made larger than a groove width Wa opened at the inner peripheral wall 2*c* of the valve body guiding hole 2, at the time of injection molding of the throttle bodies. Further, the upstream sides of the bypass air passages 15 are connected with the external side parts 7*g* of the air control grooves 7 having the large groove width Wb. Thereby, degree of freedom for designing the bypass air passage 15 can be increased.

This state is illustrated in FIG. 2.

Furthermore, the groove width of the air control grooves 7, which are opened at the inner peripheral wall 2*c* of the valve body guiding hole 2, is made to be a large groove width Wc at the upper side of the valve body guiding hole 2, and is made to be a small groove width Wd at the lower side of the valve body guiding hole 2, at the time of injection molding of the throttle bodies. Thereby, the large amount of the bypass air can be supplied in the final stage of opening of the air control valve 14.

The air control groove 7 having these groove widths is illustrated in FIG. 3.

In addition, while the air bypass device in a multiple throttle body is used in this embodiment, the number of connected throttle bodies is not restricted, and the air control grooves corresponding to the number of connected throttle bodies can be designed.

Further, single throttle bodies can be used to make the multiple throttle body by means of these throttle bodies being fixed with an attaching stay. At this time, the air control valve main body can be integrally formed with the single throttle body.

Furthermore, the bypass air passages opened at the air distribution chambers can be connected and opened at the downstream side from the respective throttle valves by using pipe materials such as metal pipes, rubber pipes, plastic pipes or the like.

What is claimed is:

1. An air bypass device in a multiple throttle body, comprising intake passages, which are provided in a plurality of throttle bodies provided sideward, and are controlled to be opened/closed by throttle valves, and bypass air passages, which bypass the throttle valves and are opened toward respective intake passages at the downstream side from the throttle valve, wherein a valve body guiding hole is provided in an air control valve main body so as to be approximately rectangular to a longitudinal axial line of the intake passage;

a bush inserting hole and a valve body drive mechanism inserting hole are provided continuously and upwardly from an upper end of the valve body guiding hole through a locking stepped part;

an air flow-in hole is downwardly provided from a lower end of the valve body guiding hole;

a plurality of independent air control grooves are opened and recessed at an inner peripheral wall of the valve body guiding hole downwardly from the locking stepped part of the upper end of the valve body guiding hole;

the air control grooves are formed as a plurality of independent air distribution chambers by an annular bush which is provided in the bush inserting hole and contacted to the locking stepped part by a valve body drive mechanism provided in the valve body drive mechanism inserting hole;

an air flow-in passage communicating with an intake passage at the upstream side from throttle valve is opened and connected with the air flow-in hole;

the respective independent air distribution chambers are opened and connected with the respective intake passages at the downstream side from the throttle valves through bypass air passages; and the respective air control grooves opened at the inner peripheral wall of the valve body guiding hole are controlled to be opened/closed synchronously by an air control valve operated by the valve body drive mechanism.

2. The air bypass device in a multiple throttle body as claimed in claim 1, wherein the air flow-in passage, the valve body guiding hole, a plurality of the air control grooves, the bush inserting hole, and the valve body drive mechanism inserting hole at the air control valve main body are integrally formed by casting.

3. The air bypass device in a multiple throttle body as claimed in claim 1, wherein the air control grooves are formed such that a groove width of external parts is larger than a groove width of the parts opened at the inner peripheral wall of the valve body guiding hole, and the upstream sides of the bypass air passages are connected with the external parts of the air control grooves.

4. The air bypass device in a multiple throttle body as claimed in claim 2, wherein the air control grooves are formed such that a groove width of the grooves opened at the inner peripheral wall of the valve body guiding hole is made smaller toward lower side from the upper locking stepped part.

5. The air bypass device in a multiple throttle body as claimed in claim 1, wherein the air control main body is integrally formed between adjacent throttle bodies.

* * * * *